US006915749B2

(12) United States Patent
Chang

(10) Patent No.: US 6,915,749 B2
(45) Date of Patent: Jul. 12, 2005

(54) TABLE TOP

(76) Inventor: Kun-Shung Chang, No. 34, Chung-Cheng Rd., Chu-Chi Tsun, Chu-Chi Hsiang, Chia-I Hsien (TW)

( * ) Notice: Subject to any disclaimer, the term of this patent is extended or adjusted under 35 U.S.C. 154(b) by 62 days.

(21) Appl. No.: 10/615,752

(22) Filed: Jul. 9, 2003

(65) Prior Publication Data

US 2005/0005827 A1 Jan. 13, 2005

(51) Int. Cl.[7] ..... A47B 13/00
(52) U.S. Cl. ..... 108/161
(58) Field of Search ..... 108/161, 153.1, 108/59, 90; 52/721.1; 211/183

(56) References Cited

U.S. PATENT DOCUMENTS 1,196,698 A * 8/1916 Keller ..... 108/161
3,062,604 A * 11/1962 Hodgen ..... 108/161
3,150,032 A * 9/1964 Rubenstein ..... 108/161
3,212,952 A * 10/1965 Turner ..... 108/161
3,421,679 A * 1/1969 Goldman ..... 108/161
3,376,279 A * 7/1972 Beaver ..... 108/161
3,931,772 A * 1/1976 Puccio et al. ..... 108/161
4,822,661 A * 4/1989 Battaglia ..... 108/161
6,659,023 B2 * 12/2003 Saltzman et al. ..... 108/161

FOREIGN PATENT DOCUMENTS

JP 02297304 A * 12/1990 ..... A47B/13/00

* cited by examiner

*Primary Examiner*—Jose V. Chen
(74) *Attorney, Agent, or Firm*—Trop, Pruner & Hu, P.C.

(57) ABSTRACT

A table top includes a metal base, a cover body adhered to the metal base through a first adhesive layer, and a top plate adhered to the cover body through a second adhesive layer. The metal base includes a metal plate, and a metal frame underlying the metal plate. The cover body covers the metal base. The top plate overlies the cover body, and is made of a stony material. The table top further includes first and second fibrous screens, which are embedded respectively within the first and second adhesive layers.

5 Claims, 3 Drawing Sheets

TABLE TOP

BACKGROUND OF THE INVENTION

1. Field of the Invention

The invention relates to a table top, more particularly to a table top which includes a layer of stony material.

2. Description of the Related Art

Conventional table tops easily deform and crack when exposed to sunlight and rain due to the materials used in manufacturing the same. To solve the aforesaid drawbacks, a table top made of stone has been proposed heretofore. However, conventional table tops made of stone are relatively expensive, difficult to obtain, and hard to move from one place to another due to its inherent heavy weight, thereby resulting in higher transport and processing costs.

SUMMARY OF THE INVENTION

Therefore, the object of the present invention is to provide a table top which is relatively light weight while still possessing a stony appearance and a durable construction.

According to this invention, a table top comprises a metal base including a metal plate and a metal frame underlying the metal plate, a cover body covering the metal base, and a top plate overlying the cover body and made of a stony material.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
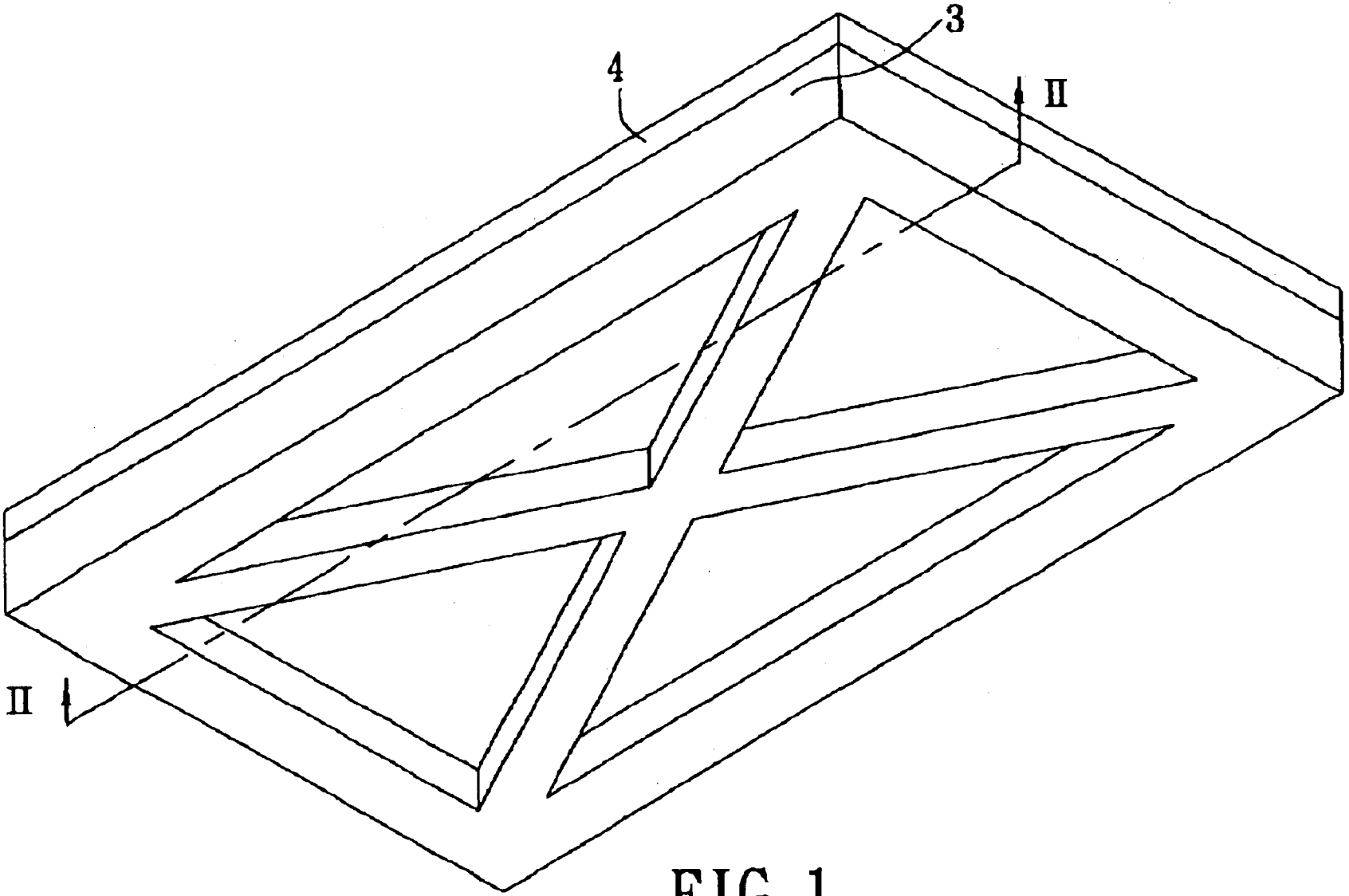
FIG. 1 is a perspective view of the preferred embodiment of a table top according to the present invention.
Figure 2:
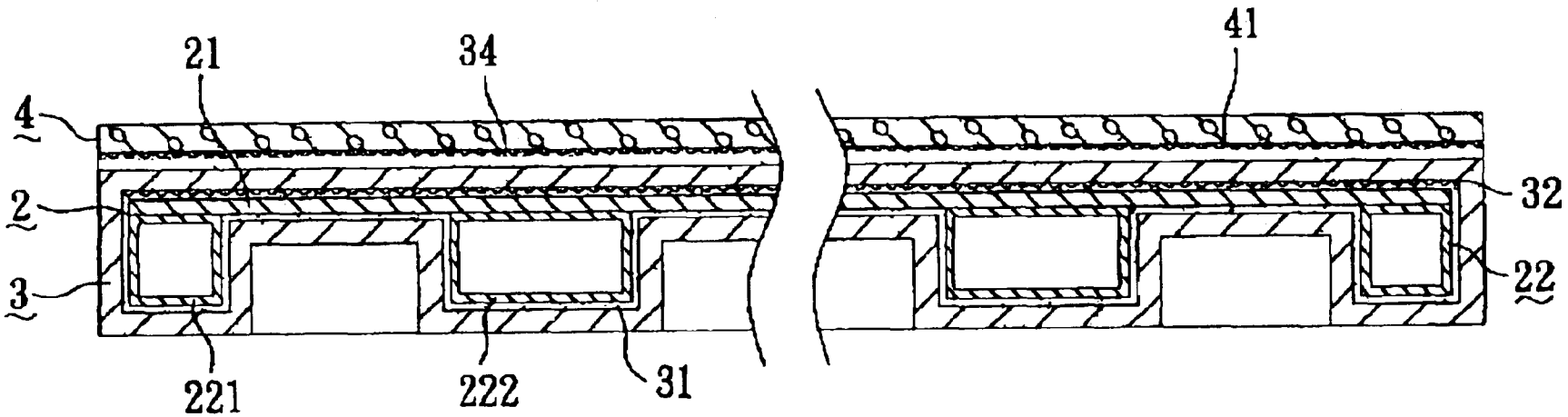
FIG. 2 is a fragmentary sectional view of the preferred embodiment taken along line II—II of FIG. 1.
Figure 3:
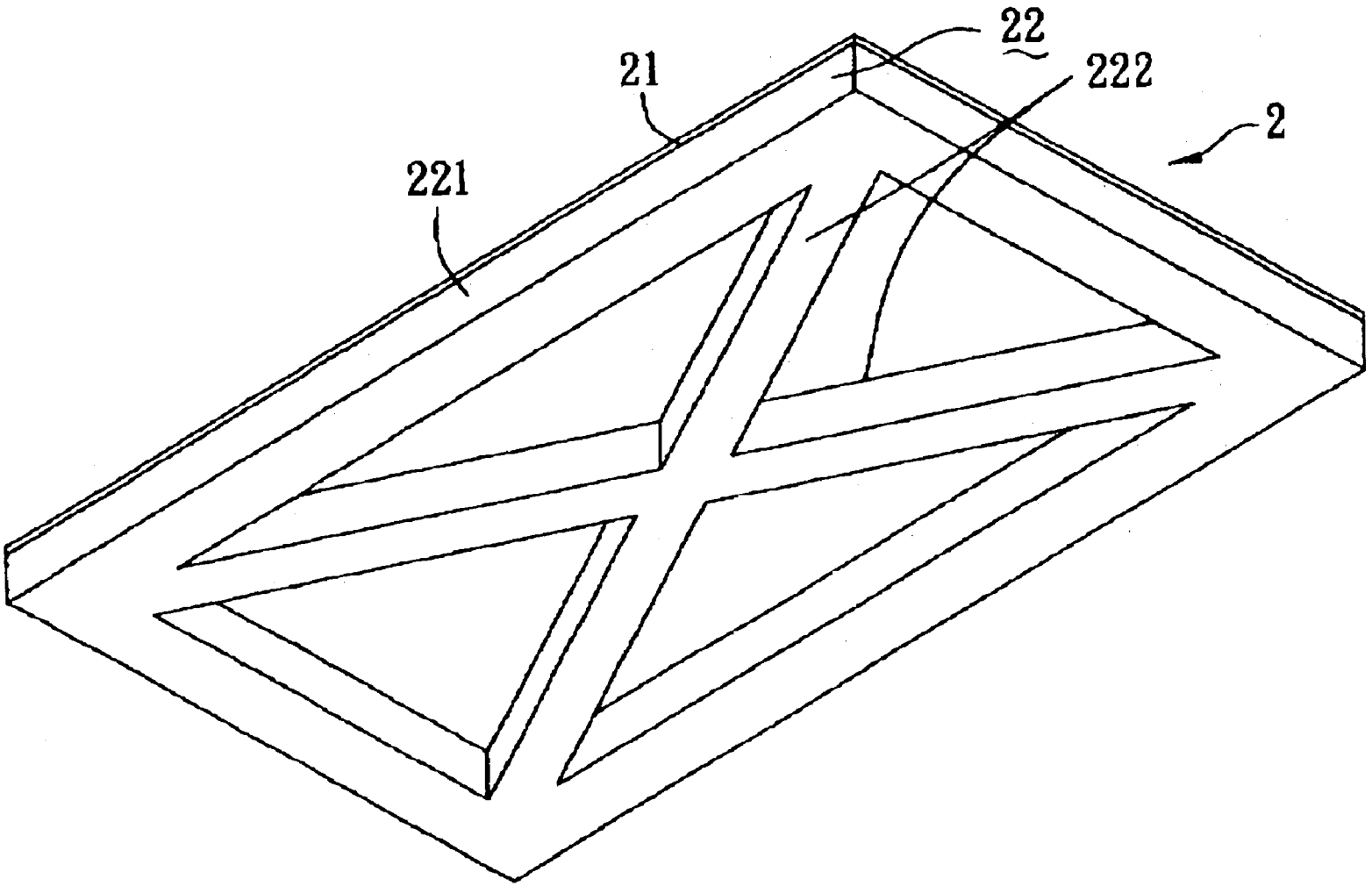
FIG. 3 is a perspective view of a metal base of the preferred embodiment.

Referring to FIGS. 1 to 3, the preferred embodiment of a table top according to the present invention is shown to comprise a metal base 2 (see FIG. 3), a cover body 3, a first adhesive layer 31, a first fibrous screen 32, a second adhesive layer 34, a second fibrous screen 41, and a top plate 4.

The metal base 2 includes a metal plate 21, and a metal frame 22 underlying the metal plate 21. The metal frame 22 includes a rectangular frame part formed of a metal tube, particularly, a four-sided frame part 221 formed of four metal tubes. A pair of diagonal tubes 222 intersect each other, and are connected to four corners of the frame part 221. The metal frame 22 is welded fixedly to a bottom surface of the metal plate 21 so as to increase the supporting strength of the metal plate 21. An outer surface of the metal base 2 is processed through a sand spraying process so as to provide an improved adhesion surface. The metal plate 21 and the metal frame 22 of the metal base 2 can be made of an aluminum alloy or iron. The metal plate 21 has a thickness ranging from 0.5–0.8 mm, and can be circular or rectangular in shape. Each of the diagonal tubes 222 has a square cross-section with each side thereof having a dimension of about 10 mm. However, the present invention should not be limited to the aforementioned material, shape, and dimension of the metal base 2.

The cover body 3 is made of a stony material, and is molded over the metal base 2 so that the cover body 3 encloses entirely the metal base 2. The stony material of the cover body 3 is composed of a resinous binder and a stone powder.

The first adhesive layer 31 is disposed between the cover body 3 and the metal base 2 so as to enhance adhesion between the cover body 3 and the metal base 2.

The first fibrous screen 32 is embedded within the first adhesive layer 31 so as to enhance the adhering strength between the cover body 3 and the metal plate 21 of the metal base 2.

Since the cover body 3 is composed of a resinous binder and a stone powder, and since the first fibrous screen 32 is embedded within the first adhesive layer 31, when an object is placed on top of the cover body 3, the strength of the latter can be reinforced against compression. After being polished, the cover body 3 possesses an outer appearance which is substantially similar to that of a natural stone, but has a weight relatively lighter than that of the natural stone. The thickness of the cover body 3 in this embodiment is about 5 mm, but should not be limited thereto.

The top plate 4 overlies the cover body 3, and is made of a stony material. The stony material of the top plate 4 comprises granular stones, a stone powder, and a resinous binder. The stony material is formed into a predetermined decorative pattern by using the shapes and colors of the granular stones and the stone powder.

The second adhesive layer 34 is disposed between the top plate 4 and the cover body 3 so as to adhere fixedly the top plate 4 to the cover body 3.

Each of the first and second adhesive layers 31, 34 is made of a vinyl-ester resin that can withstand high temperatures. Preferably, each of the first and second adhesive layers 31, 34 is used in an amount of about 0.2–0.3 kg/square meter. However, the present invention should not be limited thereto.

The second fibrous screen 41 is embedded within the second adhesive layer 34 so as to enhance the adhering strength between the cover body 3 and the top plate 4.

The top plate 4 is adhered fixedly to the cover body 3 through the second adhesive layer 34 and the second fibrous screen 41. An outer surface of the top plate 4 is subjected to a polishing treatment so as to form a smooth decorative table top. The top plate 4 not only can tolerate heat, but is also resistant to deformation and cracking produced upon constant exposure to sunlight and rain. The table top according to the present invention is quite durable. The thickness of the top plate 4 may be designed with different dimensions according to the intended use. Generally, the thickness of the top plate 4 may range from 0.3 to 0.8 mm.

Since the table top of the present invention uses the metal base 2 which has a relatively large supporting strength, the cover body 3 which is easy to process and which has the outer appearance resembling stones, and the top plate 4 which has an appealing appearance and which is durable, the present invention provides a table top which is lightweight, relatively easy to process, and durable.

While the present invention has been described in connection with what is considered the most practical and preferred embodiment, it is understood that this invention is not limited to the disclosed embodiment but is intended to cover various arrangements included within the spirit and scope or the broadest interpretation so as to encompass all such modifications and equivalent arrangements.

I claim:

1. A table top comprising:

a metal base including a metal plate and a metal frame underlying said metal plate;

a cover body enclosing entirely said metal base, and being made of a stony material;

a top body overlying said cover body and made of a stony material;

a first adhesive layer between said cover body and said metal base so as to adhere said cover body to said metal base; and a first fibrous screen embedded within said first adhesive layer.

2. The table top as claimed in claim 1, further comprising a second adhesive layer between said top plate and said cover body so as to adhere said top plate to said cover body, and a second fibrous screen embedded within said second adhesive layer.

3. The table top as claimed in claim 2, wherein each of said first and second adhesive layers includes a vinyl-ester resin.

4. The table top as claimed in claim 1, wherein said stony material of said cover body is composed of a resinous binder and a stone powder.

5. The table top as claimed in claim 1, wherein said metal frame of said metal base includes a rectangular frame part formed of a metal tube, and a pair of diagonal tubes intersecting each other and connected to four corners of said frame part.

* * * * *